United States Patent [19]

Digenis et al.

[11] 4,202,356

[45] May 13, 1980

[54] TOBACCO SMOKE FILTER MATERIAL

[75] Inventors: George A. Digenis; Manvendra B. Shambhu, both of Lexington, Ky.

[73] Assignee: University of Kentucky Research Foundation, Lexington, Ky.

[21] Appl. No.: 703,319

[22] Filed: Jul. 8, 1976

[51] Int. Cl.[2] ..... A24B 15/02; A24D 1/06; C08F 8/00; C08F 8/18

[52] U.S. Cl. ..... 131/10.9; 131/269; 525/326; 525/375

[58] Field of Search ..... 131/269, 9, 10 R, 10.9, 131/10.7; 526/13, 50

[56] References Cited

U.S. PATENT DOCUMENTS

| | | | |
|---|---|---|---|
| 4,002,177 | 1/1977 | Rainer et al. | 131/269 |
| 4,038,470 | 7/1977 | Stehlicek et al. | 526/50 |

FOREIGN PATENT DOCUMENTS

| | | | |
|---|---|---|---|
| 1960040 | 7/1973 | Fed. Rep. of Germany | 131/269 |

OTHER PUBLICATIONS

Chem. Abstract, vol. 78, No. 25–26; 160361g, "Polystyrene Based Polymer Containing Amino Groups": Sokolova et al., 1973.

Chem. Abstract, vol. 82, 1975, No. 15–16; 105177j, "Polymer Composition for Photographic Emulsions", Miyamura et al.

Chem. Abstract, vol. 83, 1975, No. 7; 58,713q, "Reaction of Dimethyl Imidazole–4,5–Dicarboxylate with Sytrene Oxide", by Cooper et al.

*Primary Examiner*—V. Millin

*Attorney, Agent, or Firm*—Birch, Stewart, Kolasch and Birch

[57] ABSTRACT

A tobacco smoke filter comprising a imidazole-containing polymer, the imidazole groups being chemically bound to said polymer.

9 Claims, No Drawings

TOBACCO SMOKE FILTER MATERIAL

BACKGROUND AND SUMMARY OF THE INVENTION

The present invention relates to a tobacco filter. More particularly, the present invention is directed to a tobacco smoke filter that is selective in the removal of various constituents, for example, hydrogen cyanide, phenols, and various amines from the smoke stream.

A wide variety of materials have been suggested in the prior art as filters for tobacco smoke. Thus, such products as cotton, paper, asbestos, regenerated cellulose, and certain synthetic fibers have been disclosed as filter media for tars and nicotine of cigarettes, pipe and cigar smoke.

Although the above materials remove a certain portion of the particulate, or liquid-solid phase of tobacco smoke, such as boiling tar and nicotine particles, these materials are of little value in removing the constituents in the gaseous phase of the smoke.

Although some of the gaseous constituents of tobacco smoke are desirable from the standpoint of taste, flavor and aroma, others, such as for example, aldehydes, phenols, and gas phase cyanide are undesirable and are quite irritating to the smoker's throat and lungs. In order to remove such vapors from tobacco smoke, various adsorbents or absorbents have been suggested in prior filters. Thus, materials such as silica gel, activated aluminum oxide, charcoal, and diatomaceous earths have been used. However, such products have many undesirable features, such as for example, the adsorption of moisture, odors, and the like. Also, said materials are not effective in the selective removal of the potentially harmful constituents of smoke, such as cyanides, phenols, aldehydes, and amines.

The isolation and identification of toxic substances in tobacco smoke is an essential part of deriving a relationship between smoking and health. A number of in vitro assay systems have been utilised to evaluate the toxicity of smoke. It is well recognised that tobacco smoke contains ciliotoxic substances capable of stopping the beating of cilia in the trachea. Ciliostasis is generally regarded as an index of cytotoxicity and can bring about a failure of the lung clearance mechanism. Hence the ciliostatic activity of smoke is considered by many workers as a measure of toxicity. Recently it has been shown that tobacco smoke contains a volatile factor which inhibits the activity of mammalian cytochrome oxidase. This inhibition of the ATP-generating system may contribute to some of the toxic effects of tobacco smoke.

Accordingly, an object of the present invention is to provide a tobacco smoke filter material that can be readily incorporated into filters for cigarettes, cigars and/or pipes.

Another object of the present invention is to provide an improved tobacco smoke filter which is effective in selectively removing potentially harmful constituents, such as for example, cyanides, phenols, aldehydes, and smoke, from a tobacco smoke stream.

A further object of the present invention is to provide a tobacco smoke filter material which contains a reactive chemical function chemically incorporated therein, said chemical function being capable of reacting with nucleophiles in tobacco smoke without losing its active component due to volatilization.

A still further object of the present invention is to provide a tobacco smoke filter which will remain effective for the removal of the potentially harmful constituents of smoke, such as cyanides, phenols, aldehydes, and amines, even after prolonged exposure to moisture vapor or tobacco odors as are normally encountered in a sealed package of cigarettes. Yet another object of the present invention is to provide a polystyrene-based resin with chemically active functions for use in isolating tobacco smoke fractions which exhibit toxicity.

According to the present invention, the preparation of the tobacco smoke filter material of the present invention is based upon the introduction of particular reactive chemical functions to an otherwise inert polymeric support material. Thus, the tobacco smoke filter material of the present invention comprises an imidazole-containing polymeric support material, said imidazole group being chemically bound to said polymeric support material. Although many polymers can be utilized to meet the requirements of the polymeric support material, polystyrene was found to be particularly effective as the polymeric support material utilized in the present invention. Thus, polystyrene will be referred to hereinafter as being exemplary of the support polymers which can be utilized in the present invention.

The synthesis of the chemically active resin can be achieved in three stages, that is, (A) the preparation of the polymeric support material, for example, polystyrene, (B) the introduction of carboxylic acids into the phenyl groups of the polystyrene, and (C) the conversion of the acid functions into active acyl imidazole groups.

(A) THE PREPARATION OF THE POLYMERIC SUPPORT MATERIAL

The preparation of the polymeric support material, for example, a styrene polymer, and particularly "popcorn" polystyrene, was found to be a particularly effective resin because of its porosity, large surface area, and the ease with which it can be micromerized to the desired particle size. Popcorn polystyrene which is a white, porous, and brittle polystyrene of irregular shape, can be prepared by the copolymerization of styrene with a small amount of divinylbenzene.

(B) INTRODUCTION OF CARBOXYLIC ACID FUNCTIONS INTO POLYSTYRENE

A variety of known chemical routes can be utilized for attaching the carboxylic acid groups to the polymer and the acid functions can be introduced into polystyrene, for example, by utilizing a carboxylic acid containing from about 1 to 6 carbon atoms, such as for example, the succinyl function (see structure I) or a two-carbon unit ($—CH_2COOH$).

I

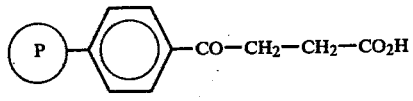

In one procedure the succinylation is achieved by carrying out the Friedel-Crafts reaction on the polystyrene.

In another procedure, when the polystyrene resin is treated with a carboxylic acid having a two-carbon chain ($—CH_2COOH$), it is advantageous to first prepare chloromethylated polystyrene (II); secondarily prepare cyanomethyl polystyrene (III); and thirdly, prepare the polymer with carboxylic functions (IV). The three reactions necessary to prepare the two-carbon chain carboxylic acid function can be outlined as follows:

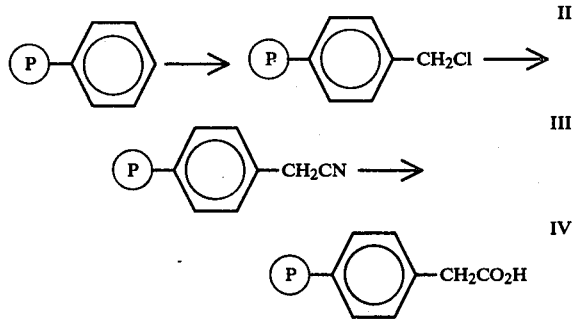

As previously stated the above procedure (II–III–IV) is merely exemplary of known methods for the attachment of carboxylic acid groups to the polymeric support material.

(C) PREPARATION OF THE RESINS WITH ACYLIMIDAZOLE FUNCTION

The carboxylic acid functions can then be converted into the desired imidazole functional group by the following sequence:

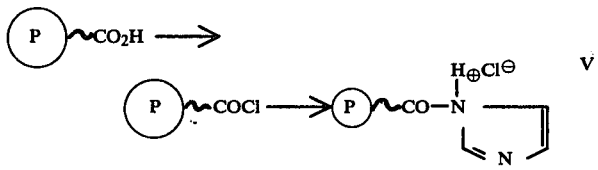

Here again, this above sequence is exemplary of known methods for converting the acid functions into an imidazole.

The resulting resins (V) exhibited typical amide absorption and the nitrogen and chlorine content was in accordance with that of structure V.

THE REMOVAL OF VARIOUS UNDESIRABLE CONSTITUENTS FROM THE SMOKE STREAM

The imidazole functions on the polystyrene resins react with nucleophiles in the smoke, such as for example, phenols, amines and cyanides in a manner shown by the following equation:

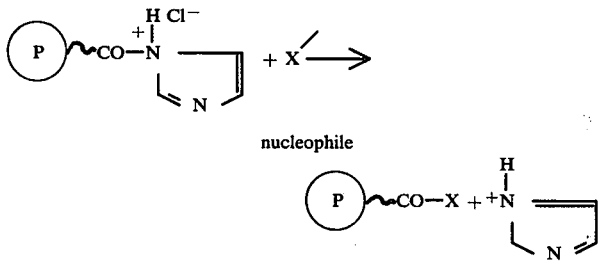

The net result is the immobilization of the nucleophile onto the filter material. The filter material is in the form of an insoluble resin onto which active chemical functions are created by chemical processes in such a manner that the active component is not lost due to volatilization.

Although "popcorn" polystyrene has been utilized by way of example in the preparation of the filter materials of the present invention, it is readily apparent that other forms of polystyrene as well as other polymers may be utilized as the polymeric support material to which an imidazole functional group can be chemically bound. Other polystyrenes which can be utilized include those which are obtained by solution and suspension polymerization, including polystyrene in the form of a foam. Copolymers of styrene with other monomers may also be utilized for the purpose of the present invention. Other polymers which can be utilized in the present invention include any polymers which can be modified to contain the carboxylic acid functions. Suitable polymers which can be used as the polymeric support include, for example, polyacrylates, polyurethanes, polyolefins containing two-eight carbon atoms, polyesters, cellulosic materials, for example, cellulose acetate, and the like. Advantageously, such polymers are in the form of porous granules.

The carboxylic acids or acid anhydrides which can be utilized in the present invention contain from about 1 to 6 carbon atoms and preferably 2 to 4 carbon atoms. Typical carboxylic acids include acetic acid, propionic acid, butyric acid, valeric acid, caproic acid, acrylic acid, oxalic acid, malonic acid, succinic acid, glutaric acid and adipic acid. Particularly desired acids are acetic acid and succinic acid.

The present invention will now be illustrated with reference to the following examples which are not to be considered as limiting the present invention.

EXAMPLE (A) Preparation of "Popcorn" Polystyrene

This form of polystyrene can be prepared by the copolymerization of styrene with about 0.2% of divinylbenzene. The polymerization is carried out at 55° in the absence of air after the addition of a few seeds of the polymer and usually requires 48 hours to be complete. After washing with organic solvents, the polymer is dried and reduced to the desired particle size. A description of "popcorn" polystyrene can be found in U.S. Pat. No. 3,603,319.

(B) Introduction of Carboxylic Acid Function into a Polymeric Support Material (1) Introduction of a 4 Carbon Carboxylic Acid Function into Polystyrene The introduction of the succinyl function into polystyrene is achieved by carrying out the Friedel-Crafts reaction on the polystyrene as follows: 30 grams of the polymer is suspended in a mixture of 100 ml of nitrobenzene and 100 ml of tetrachloroethane. A solution comprising 60 grams of anhydrous aluminum chloride, 100 ml of nitrobenzene and 100 ml of tetrachloroethane is then added to the polymeric suspension, followed by the addition of a solution comprising 30 grams of succinic anhydride, 50 ml of nitrobenzene and 50 ml of tetrachloroethane. The mixture is then mechanically stirred while maintaining the temperature at 85° C. for 3 hours. The polymer is separated by filtration and repeatedly washed with the following solvents: nitrobenzene, dioxane, dioxane-water, water-dioxane, and methanol. The polymer is dried at 60° C. at reduced pressure. The IR spectrum (KBr pellet) exhibited strong bands at 3300, 1680, and 820 $cm^{-1}$. By titrating the acid functions on the polymer against a sodium hydroxide solution, the polymer was found to contain about 2 meq of the acid functions per gram.

(2) Introduction of a 2 Carbon Unit Carboxylic Acid Function into Polystyrene

To prepare the polystyrene resin with two-carbon, carboxylic acid functions, it is advantageous to first prepare chloromethylated polystyrene, then prepare cyanomethyl polystyrene and finally prepare the polymer with carboxylic functions.

(a) Preparation of Chloromethylated Polystyrene

A solution comprising 35 ml of anhydrous stannic chloride in 90 ml chloromethylmethyl ether is added to a suspension of 70 grams of polystyrene in 500 ml chloroform at a temperature of 0° C. over a period of 30 minutes. The mixture is stirred at room temperature for 2 hours and filtered. The polymer is washed exhaustively with chloroform, dioxane, dioxane-water, water and methanol. After drying at 60° C. under reduced pressure, 85 grams of the polymer is found to contain 3.5 meq for chlorine per gram.

(b) Preparation of the Polymer with Carboxylic Functions

Twenty (20) grams of the above polymer is added to a mixture of 55 ml sulfuric acid, 55 ml acetic acid, and 55 ml of water. The mixture is refluxed for 10 hours. The polymer is separated by filtration and washed repeatedly with hot water and methanol. The IR spectrum of 21 grams of the dry resin exhibited strong bands at 3500 and 1705 $cm^{-1}$. The resin is found to contain 3.2 meq of acid functions per gram by titration with a standard sodium hydroxide solution.

(C) Preparation of the Resins with Acylimidazole Functions

The carboxylic acid functions are converted to reactive acylimidazole functions by the following procedure: 10 grams of succinylated polystyrene or polystyrene with a two-carbon chain carboxylic acid function is suspended in 100 ml of anhydrous benzene. Five (5) ml of oxalyl chloride is added dropwise over 30 minutes while refluxing. After filtration and washing with benzene, the polymer is suspended in 100 ml of benzene and a hot solution comprising 4 grams of imidazole and 20 ml of benzene is added thereto. After refluxing the mixture for 2 hours, the polymer is collected by filtration and washed repeatedly with hot benzene. The weight increase of 15 to 30% is dependent upon the number of carboxylic acid functions on the polymer and the extent of washing. Upon complete washing in a soxhlet, the resin exhibited a typical amide absorption at 1680 $cm^{-1}$.

In order to illustrate the effectiveness of the filter material of the present invention, 150 mg of the resin prepared above and having a mesh of 40–100 is incorporated into a cigarette filter disposed at the end of a cigarette and the filtration properties are compared with those wherein an unfunctionalized styrene resin is utilized. The cigarettes are smoked on a machine using 12 puffs per cigarette. The smoke from the cigarettes is first passed through a cambridge filter to remove the particulate matter and then scrubbed with water (40 $cm^3$) after being absorbed on silica gel. The aqueous extracts from the two sets of filters are collected separately and the results are shown in Table I.

TABLE I

| Filter Type | TPM mg/cig | Nicotine mg/cig | Gas phase cyanide μg/ml smoke | Total aldehydes μg/ml | Total Phenols μg/cig |
|---|---|---|---|---|---|
| Polystyrene | 27.5 | 1.6 | 0.38 | 3.7 | 107 |
| Activated Polystyrene | 24.4 | 1.4 | 0.22 | 2.1 | 47 |

The activated resin was also tested for toxicity towards cilia movement using hamster tracheae rings and inhibition towards the bacterial cytochrome oxidase using oxygen utilisation as the quantitative measure. The toxicity ratio of the water-soluble smoke extracts obtained after passing through the functionalized polystyrene and the unfunctionalized polystyrene is found to 5:7 and 1:4 in the ciliostasis and cytochrome oxidase assays, respectively. Thus the chemically active resin is significantly more effective in trapping the toxic components than the non-functionalised resin.

The results obtained by using the cytochrome C oxidase system and the toxicity to Tetrahymena, as determined by the time of death for this microorganism, are given in Table II.

TABLE II

| Resin and Amount | Relative Toxicity to Cytochrome C | Relative Toxicity to Tetrahymena |
|---|---|---|
| Polystyrene 150 mg | 100 | 100 |
| Acylimidazole Resin | | |
| 150 mg | 25 | 40 |
| 350 mg | | 20 |

It is readily apparent that the tobacco smoke filter material of the present invention can be readily incorporated into filters for cigarettes, cigars or pipes. The material is in the form of an insoluble resin onto which active chemical functions are created by chemical processes in such a manner that the active component cannot be lost due to volatilization. Due to the reactivity of the functions toward the potentially harmful constituents of smoke such as cyanides, phenols, aldehydes and amines, these substances can be selectively removed from the smoke stream. Thus, the mechanism of filtration is distinct from the physical adsorption or absorption phenomena associated with filter materials such as charcoal. By using beads of irregular shape and a mesh size of about 40–100, the pressure drop is maintained at a minimum.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

It is claimed:

1. A tobacco smoke filter comprising an imidazole-containing polymer wherein the imidazole has an acyl functional group, said imidazole being chemically bound to said polymer.

2. The tobacco smoke filter of claim 1, wherein the polymer is a styrene polymer.

3. The tobacco smoke filter of claim 1 having the following structural formula:

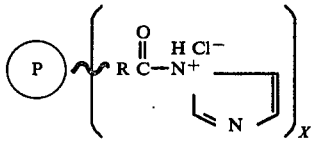

wherein

P is the polymer,

R is an alkyl group of 2 to 4 carbon atoms, and

X is an integer.

4. A smoking device comprising tobacco and a filter therefor, said filter including an imidazole-containing polymer having an acyl functional group, the imidazole being chemically bound to said polymer.

5. The smoking device of claim 5, wherein the polymer is a styrene polymer.

6. The smoking device of claim 4 wherein the imidazole-containing polymer has the following structural formula:

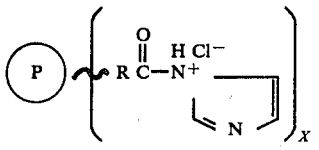

wherein

P is the polymer,

R is an alkyl group of 2 to 4 carbon atoms, and

X is an integer.

7. A method for producing a tobacco smoke filter which comprises introducing carboxylic groups into a styrene polymer and converting the carboxylic acid groups into an imidazole having an acyl functional group to form an insoluble polymeric support material containing imidazole groups.

8. An imidazole-containing polymer, wherein the imidazole has an acyl functional group, said imidazole being chemically bound to said polymer.

9. An imidazole-containing polymer having the following formula

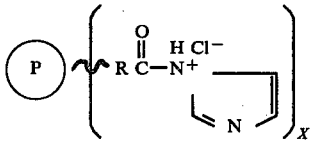

wherein

P is the polymer,

R is an alkyl group of 2 to 4 carbon atoms, and

X is an integer.

* * * * *